US010132544B2

(12) United States Patent
Yang

(10) Patent No.: US 10,132,544 B2
(45) Date of Patent: Nov. 20, 2018

(54) ICE-MAKING DEVICE FOR REFRIGERATOR

(71) Applicant: Dongbu Daewoo Electronics Corporation, Seoul (KR)

(72) Inventor: Sung Jin Yang, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 0 days.

(21) Appl. No.: 15/481,153

(22) Filed: Apr. 6, 2017

(65) Prior Publication Data

US 2017/0292753 A1 Oct. 12, 2017

(30) Foreign Application Priority Data

Apr. 8, 2016 (KR) ..... 10-2016-0043673

(51) Int. Cl.

| | |
|---|---|
| ***F25C 5/00*** | (2018.01) |
| ***F25C 5/18*** | (2018.01) |
| ***F25C 5/182*** | (2018.01) |
| ***F25C 5/20*** | (2018.01) |

(52) U.S. Cl.

CPC ..... *F25C 5/005* (2013.01); *F25C 5/182* (2013.01); *F25C 5/22* (2018.01); *F25C 2400/04* (2013.01); *F25C 2400/10* (2013.01)

(58) Field of Classification Search

CPC ..... F25C 5/005; F25C 5/182; F25C 2400/10; F25C 2400/04

See application file for complete search history.

(56) References Cited

U.S. PATENT DOCUMENTS

| | | | | |
|---|---|---|---|---|
| 6,176,099 | B1 * | 1/2001 | Hynes | F25C 5/185 62/344 |
| 2005/0072167 | A1 * | 4/2005 | Oh | F25C 1/04 62/137 |
| 2005/0262866 | A1 | 12/2005 | Seo et al. | |
| 2007/0089451 | A1 * | 4/2007 | Lee | F25C 1/12 62/352 |
| 2007/0289669 | A1 * | 12/2007 | An | F25D 23/02 141/362 |
| 2008/0034780 | A1 * | 2/2008 | Lim | F25C 1/04 62/353 |
| 2008/0156023 | A1 * | 7/2008 | Kim | F25C 5/005 62/344 |
| 2009/0205358 | A1 * | 8/2009 | Smtih | F25C 5/005 62/457.1 |
| 2009/0211292 | A1 * | 8/2009 | Smith | F25C 5/187 62/344 |

(Continued)

FOREIGN PATENT DOCUMENTS

| | | |
|---|---|---|
| KR | 10-2005-0114109 A | 12/2005 |
| KR | 10-2008-0014598 A | 2/2008 |
| KR | 10-2010-0092168 | 8/2010 |

*Primary Examiner* — Kun Kai Ma

(57) ABSTRACT

An ice-making device for a refrigerator. The ice-making device includes an ice tray, an ice-storing unit, and a slide. The slide is configured to guide ice pieces discharged from the ice tray toward the ice-storing unit. The ice-storing unit includes an ice storage part configured to accommodate the ice pieces released from the ice-making unit and a drive device configured to drive a delivery member for discharging the ice pieces from the ice storage part. The ice tray extends to a location above the drive device.

7 Claims, 4 Drawing Sheets

(56) References Cited

U.S. PATENT DOCUMENTS

| | | | | |
|---|---|---|---|---|
| 2010/0037631 | A1* | 2/2010 | Choi | F25C 5/005 62/66 |
| 2010/0199701 | A1* | 8/2010 | Yoon | F25C 5/007 62/344 |
| 2010/0319373 | A1* | 12/2010 | Jeong | F25C 1/08 62/137 |
| 2010/0326118 | A1* | 12/2010 | Jeong | F25C 1/04 62/345 |
| 2011/0000248 | A1* | 1/2011 | Jeong | F25C 1/04 62/344 |
| 2011/0126576 | A1* | 6/2011 | Jeong | F25C 5/007 62/344 |
| 2011/0138821 | A1* | 6/2011 | Chase | F25C 5/007 62/71 |
| 2011/0162392 | A1* | 7/2011 | Lim | F25D 29/00 62/66 |
| 2011/0308269 | A1* | 12/2011 | Mitchell | H05K 999/99 62/320 |
| 2012/0125034 | A1* | 5/2012 | Noh | F25C 1/08 62/331 |
| 2012/0186292 | A1* | 7/2012 | Kim | F25C 1/18 62/340 |
| 2012/0227421 | A1* | 9/2012 | Kim | F25C 5/187 62/66 |
| 2012/0324919 | A1* | 12/2012 | Bortoletto | F25C 1/20 62/73 |
| 2013/0104591 | A1* | 5/2013 | Mitchell | F25C 5/18 62/344 |
| 2013/0263621 | A1* | 10/2013 | An | F25C 5/185 62/344 |
| 2013/0264929 | A1* | 10/2013 | An | F25D 17/00 312/404 |

* cited by examiner

ICE-MAKING DEVICE FOR REFRIGERATOR

CROSS-REFERENCE TO RELATED APPLICATIONS

This application is based on and claims priority from Korean Patent Application No. 10-2016-0043673, filed on Apr. 8, 2016, the disclosure of which is incorporated herein in its entirety by reference for all purposes.

TECHNICAL FIELD

Embodiments of the present disclosure relate to refrigerators, and more particularly, to ice making and dispensing mechanisms in the refrigerators.

BACKGROUND

A refrigerator is an appliance used for storing food at a low temperature and may be configured to store food (or other items) in a frozen state or a refrigerated state. The interior of the refrigerator may be generally divided into a refrigeration compartment and a freezer. The refrigerator includes a heat exchanger configured to supply cold air into the refrigerator.

The inside of the refrigerator is cooled by circulating cold air that can be continuously generated through a heat exchange process by recycling a refrigerant in an heat exchanger. The heat exchanger may include a compressor, a condenser and an evaporator. During operation, the refrigerant goes through repeated cycles of compression, condensation, expansion and evaporation. Cold air supplied into the refrigerator is uniformly distributed by convection. Accordingly, the items stored in the refrigerator can be maintained at a desired low temperature.

The heat exchanger can be installed at one side of the refrigerator and separated from the storage spaces such as the refrigeration compartment and the freezer. For example, the compression and condensation processes may be performed by the compressor and the condenser disposed within a machine located at the lower side of a rear surface of the refrigerator. In an evaporation process, the refrigerant may evaporate and thereby absorb heat from the ambient air. As a result, the ambient air surrounding the evaporator is cooled down.

A main body of the refrigerator may have a rectangular parallel-piped shape with an open front surface. Typically, the main body encloses a refrigeration compartment and freezer, each with its own door. The refrigerator may include a plurality of drawers, shelves, vegetable compartments and the like for sorting and storing different types of items.

Conventionally, top mount type refrigerators were popular, with a freezer located at an upper side and a refrigeration room located at a lower side. Recently, bottom freezer type refrigerators have been developed, where a freezer is located at the lower side. A bottom freezer type refrigerator provides the advantage that a user can conveniently access the refrigerator in general. However, a user often needs to lower down or bend down to access the freezer, e.g., for taking ice from it.

Some bottom freezer type refrigerators have an ice dispenser located at the refrigeration room compartment disposed at the upper side of the refrigerator. An ice-making device for making ice pieces may be disposed on the refrigeration compartment door or inside refrigeration compartment. The ice-making device may include an ice-making unit including an ice tray, and an ice storage part (ice bucket) for storing the ice pieces produced in the ice tray. The ice-making unit is disposed above the ice storage unit.

However, in the related art, a cold air duct or the like is typically located in the space between the inner wall of the ice-making device and the ice-making unit. Thus, the space between the inner wall of the ice-making device and the ice-making unit is not used for production or storage of ice pieces. In other words, in a conventional ice-making device, space usage efficiency is unfortunately low.

SUMMARY

Embodiments of the present disclosure provide an ice-making device with enhanced space usage efficiency.

According to an embodiment of the present invention, an ice-making device for a refrigerator includes an ice tray configured to receive water and to produce ice pieces; an ice-making unit provided with the ice tray; an ice-storing unit configured to store ice pieces produced in the ice tray and fed from the ice tray; and a slide configured to guide ice pieces discharged from the ice tray toward the ice-storing unit. The ice-storing unit includes an ice storage part configured to accommodate the ice pieces released from the ice-making unit and a drive device configured to drive a delivery member for discharging the ice pieces from the ice storage part. The ice tray extends to a space located above the drive device.

Further, the slide is located above the drive device and configured to cover an upper portion of the drive device.

Further, the slide is configured to guide some of the ice pieces discharged from the ice tray toward the ice storage part.

Further, the slide is configured to have a cross section shaped like a wave.

Furthermore, according to another embodiment of the present invention, an ice-making device for a refrigerator, includes an ice tray configured to receive water and to produce ice pieces; an ice-making unit provided with the ice tray; an ice-storing unit configured to store the ice pieces produced in the ice tray and fed from the ice tray; and a slide configured to guide the ice pieces discharged from the ice tray toward the ice-storing unit. The slide is configured to have a cross section shaped like a wave.

Further, the ice-making unit is configured to make close contact with one end wall and the other end wall of the ice-making device.

Furthermore, according to another embodiment of the present invention, the ice-making device for a refrigerator includes an ice tray configured to receive water and to produce ice pieces; an ice-making unit provided with the ice tray; an ice-storing unit configured to store the ice pieces produced in the ice tray and fed from the ice tray. The ice-making unit is configured to make close contact with one end wall and the other end wall of the ice-making device.

Further, the ice-making device for a refrigerator includes a slide configured to guide the ice pieces discharged from the ice tray toward the ice-storing unit.

Further, the ice-storing unit includes an ice storage part configured to accommodate ice pieces released from the ice-making unit and a drive device configured to drive a delivery member for discharging ice pieces from the ice storage part. The slide is located above the drive device and configured to cover an upper portion of the drive device.

DETAILED DESCRIPTION

Figure 1:
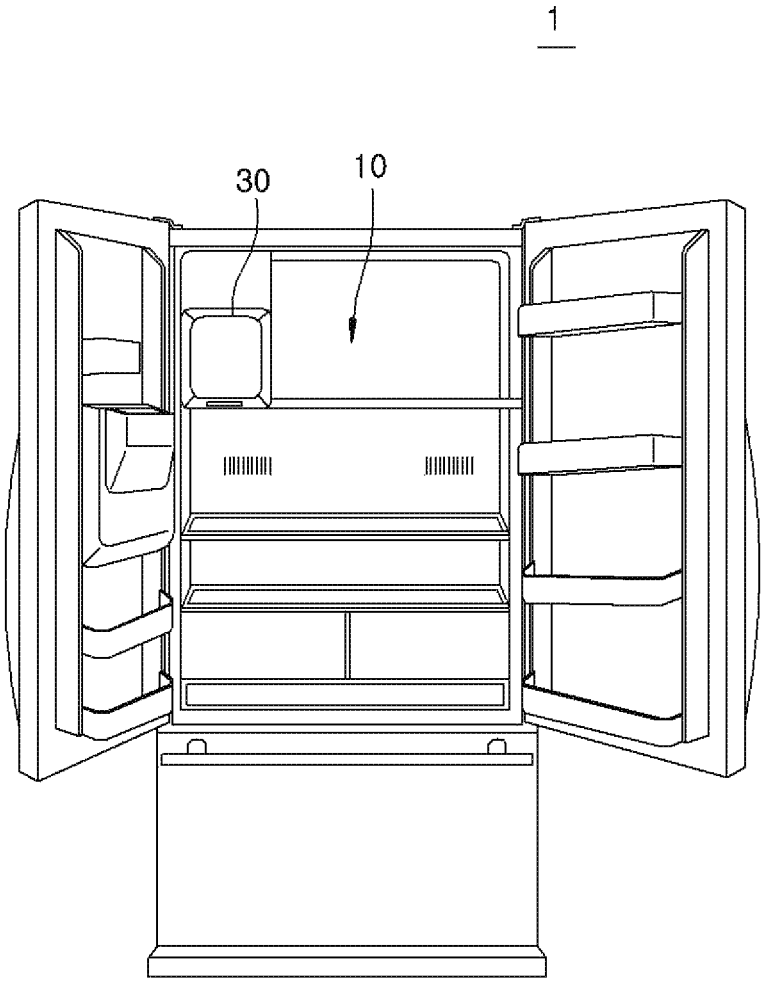
FIG. 1 is a front view illustrating the configuration of an exemplary refrigerator equipped with an ice-making device according to one embodiment of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in size, and a predetermined size is merely exemplary and not limiting. The same reference numerals designate the same structures, elements, or parts illustrated in two or more drawings in order to exhibit similar characteristics.

The exemplary drawings of the present disclosure illustrate ideal exemplary embodiments of the present disclosure in more detail. As a result, various modifications of the drawings are expected. Accordingly, the exemplary embodiments are not limited to a specific form of the illustrated region, and for example, include modification due to manufacturing.

The configuration of an exemplary ice-making device for a refrigerator according to one embodiment of the present disclosure is described with reference to FIGS. 1 to 4.

Figure 2:
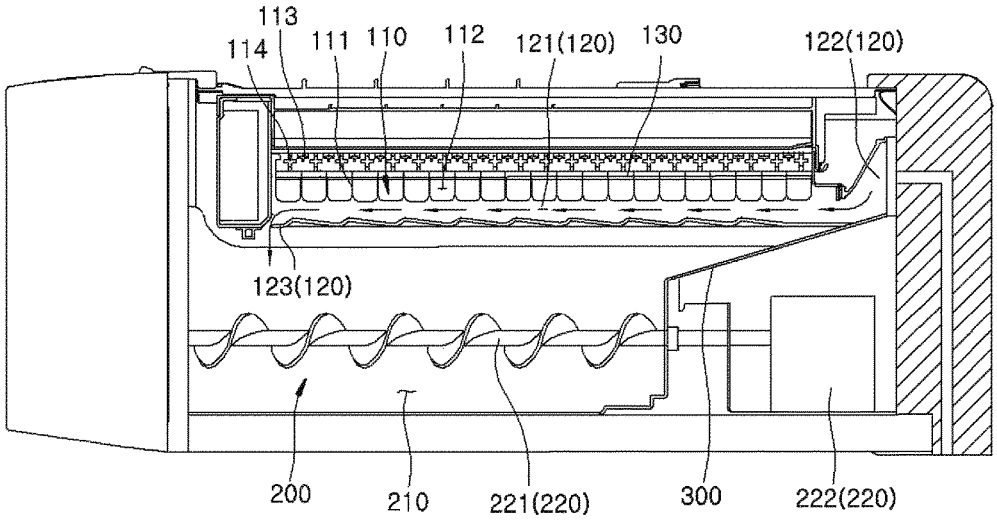
FIG. 2 is a side view illustrating the configuration of an exemplary ice-making device according to one embodiment of the present disclosure.
Figure 3:
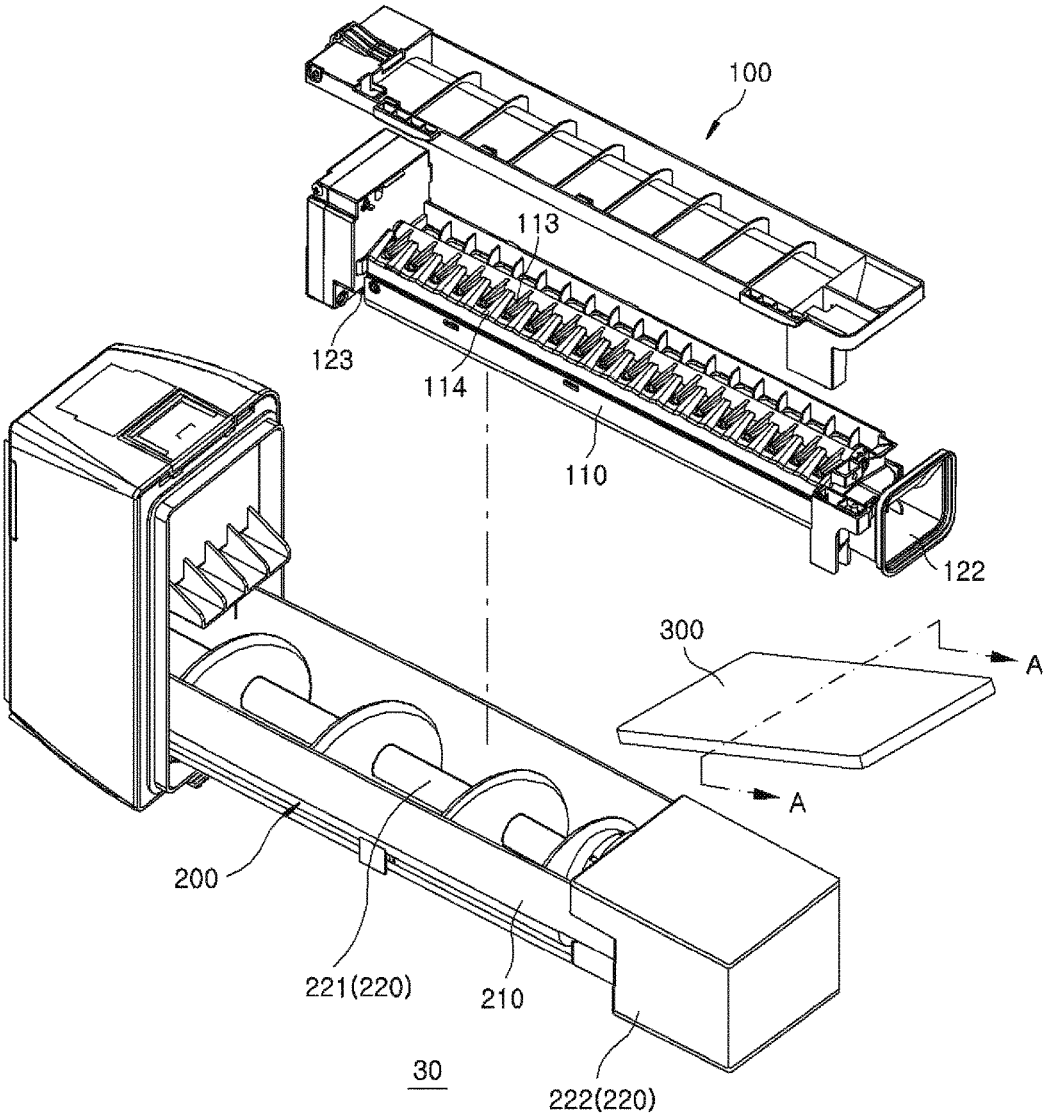
FIG. 3 is an exploded perspective view illustrating the configuration of the exemplary ice-making device in FIG. 2.
Figure 4A:
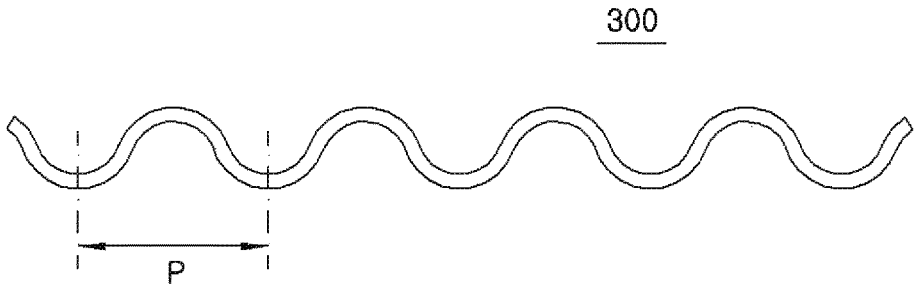
FIG. 4A is a sectional view illustrating one example of a slide taken along line A-A in FIG. 3.
Figure 4B:
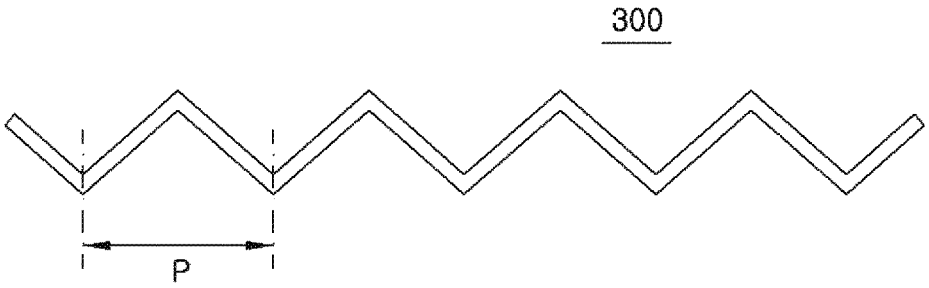
FIG. 4B is a sectional view illustrating another example of a slide taken along line A-A in FIG. 3.

FIG. 1 is a front view illustrating the configuration of an exemplary refrigerator equipped with an ice-making device according to one embodiment of the present disclosure. FIG. 2 is a side view illustrating the configuration of an exemplary ice-making device according to one embodiment of the present disclosure. FIG. 3 is an exploded perspective view illustrating the configuration of the exemplary ice-making device in FIG. 2. FIG. 4A is a sectional view illustrating one example of a slide taken along line A-A in FIG. 3. FIG. 4B is a sectional view illustrating another example of a slide taken along line A-A in FIG. 3.

Referring to FIGS. 1 to 4, the refrigerator 1 according to one embodiment of the present disclosure may include a refrigeration compartment 10 and an ice-making device 30 installed on the refrigerator 1.

The refrigerator 1 may include a cooling system (not shown) configured to supply cold air to the refrigeration compartment 10. The cooling system may include, for example, an evaporator, a compressor and a condenser. A refrigerant flows from the evaporator to the compressor. The refrigerant exiting the evaporator usually has relatively high temperature due to heat exchange with ambient air surrounding the evaporator. The refrigerant is compressed by the compressor and dissipates heat to the outside while passing through the condenser. Thus, the refrigerant is liquefied by the condenser. The liquefied refrigerant passed through the condenser is sent back to the evaporator. At the evaporator, the liquefied refrigerant is evaporated through heat exchange with the ambient air and absorbs heat from the air. Thus, the evaporator operates to cool the air in the refrigerator through this heat transfer process. At the same time, liquefied refrigerant in the evaporator is entirely or partially converted into a gaseous state. The gaseous refrigerant is then separated from the liquid refrigerant and introduced into the compressor again. Cooled air is then supplied from around the evaporator into the refrigerator compartment 10, thereby cooling the refrigerator compartment 10.

The ice-making device 30 for a refrigerator may include an ice-making unit 100, an ice-storing unit 200 and a slide 300. The ice-making unit 100, the ice-storing unit 200 and the slide 300 may be disposed in the internal space of the ice-making device 30 for a refrigerator. The ice-making device 30 may have a housing defining internal space of the ice-making device 30. The ice-making unit 100 may be disposed at the upper side and the ice-storing unit 200 may be disposed at the lower side of the ice-making unit 100.

The ice-making unit 100 may traverse from one end wall (or the first end wall) to the other end wall (or the second end wall) of the ice-making device 30. The ice-making unit 100 may closely contact one end wall and the other end wall. For example, the ice-making unit 100 may be disposed within the ice-making device 30 and may be disposed between a front wall (door-side wall) of the ice-making device 30 and a rear wall located at the opposite side from a door. The ice-making unit 100 may make close contact with the front wall and the rear wall.

The ice making process involves the operations of the ice-making unit 100 which may include an ice tray 110, a cooling system 120 and a heating unit 130.

The ice tray 110 is configured to receive water from the outside. The water in the ice tray 110 freezes into ice pieces by a cold air flow supplied from the cooling system 120. The ice tray 110 may include partition walls 111, ice cells 112 partitioned by the partition walls 111, an ice-releasing member 113 configured to discharge the ice pieces out of the ice tray 110, and an ice-releasing member guide 114 configured to guide the ice-releasing member 113. The partition walls 111 and the ice cells 112 may be of any suitable shapes. The number of the partition walls 111 and the ice cells 112 may also be variable in different embodiments.

The ice-releasing member 113 may be rotated by a drive device such as a motor or the like. The ice tray 110 may include a heat transfer member made of metal or the like. The heat transfer member enhances the efficiency of heat exchange between a cold air flow and the water. The heat transfer member may be disposed outside the ice tray 110 and may have a shape consistent with the shape of the ice tray 110. However, the present disclosure is not limited thereto.

The ice tray 110 may traverse from a location above the ice storage part 210 to a location above a drive device 222, as described in greater detail later. In this configuration, the ice tray 110 may have an enlarged capacity and include an increased number of ice cells 112. Thereby, more ice pieces can be advantageously produced by the ice tray 110 at one time than by a conventional ice tray. The ice tray 110 extends to a location above the drive device.

In the embodiments described in detail herein, ice pieces from the ice tray 110 are discharged by the ice-releasing member 113. However, this implementation is merely exemplary and the present disclosure is not limited thereto. In some other embodiments, ice pieces from the ice tray 110 may be discharged by rotating the ice tray 110.

The cooling system 120 may include a duct 121 disposed below the ice tray 110. The duct 121 may receive a cold air flow supplied from the cooling system 120. Cold air may be introduced to the duct through an inflow portion 122 of the duct 121. After flowing through the ice tray 110, cold air is discharged through an outflow portion 123 of the duct 121. Cold air discharged through the outflow portion 123 may flow toward the ice-storing unit 200.

In the embodiments described in detail herein, the cooling system 120 uses the duct 121 for supplying the cold air. However, this implementation is merely exemplary and the present disclosure is not limited thereto. For example, the cooling system 120 may include a pipe through which a refrigerant flows. The cooling system 120 may receive the refrigerant from the condenser of the cooling cycle and may make contact with the ice tray 110.

The heating unit 130 can heat the ice tray 110. The layer of an ice piece in contact with the ice tray 110 may be melted by heat generated from the heating unit 130. This enables the ice pieces to be easily released from the ice tray 110. The heating unit 130 may have a long strip shape. The heating unit 130 may be disposed around the ice tray 110. For example, the heating unit 130 may directly contact the ice tray 110 under the ice tray 110. The heating unit 130 may include a pipe through which a heat medium flows. However, this implementation is merely exemplary and the present disclosure is not limited thereto. For example, the heating unit 130 may include a resistive electric wire that generates heat from electric energy.

The ice-storing unit 200 may include an ice storage part 210 and an ice discharge part 220. The ice storage part 210 is configured to receive and contain the ice pieces produced in the ice tray 110. Furthermore, the ice storage part 210 may receive cold air flow from the cooling system 120. The ice storage part 210 may be a container having a top opening and configured to accommodate the ice pieces.

The ice discharge part 220 may discharge the ice pieces stored in the ice-storing unit 200 to the outside. The ice discharge part 220 may include a delivery member 221 and a drive device 222. The delivery member 221 may be disposed in the ice storage part 210 and may discharge the ice pieces stored in the ice storage part 210 to the outside. The delivery member 221 may be a rotary member including a central shaft and a blade. However, this implementation is merely exemplary and the present disclosure is not limited thereto.

The drive device 222 is coupled to the delivery member 221 and is configured to drive the delivery member 221. The drive device 222 may be disposed adjacent to the second end wall of the ice-making device 30. When the delivery member 221 is rotated by the drive device 222, ice pieces around the delivery member 221 drop toward an exit of the ice-making device 30. The drive device 222 may include, for example, an electric motor and the like. However, this implementation is merely exemplary and the present disclosure is not limited thereto.

The slide 300 is configured to guide the ice pieces discharged from the ice tray 110 toward the ice-storing unit 200. The slide 300 includes a slant surface having a fixed inclination angle. Furthermore, the slide 300 is disposed so that the slide 300 is inclined downward from the side of the ice-making unit 100 toward the side of the ice storage part 210. Ice pieces dropped on the slide 300 may slide along the slide 300 and thereby guided toward the ice storage part 210. The slide 300 may be disposed above the drive device 222 and may cover the upper portion of the drive device 222. Preferably, the slide 300 is disposed with a large inclination angle. For example, one end of the slide 300 may be disposed adjacent to the ice storage part 210 and the other end of the slide 300 may be disposed adjacent to the ice-making unit 100.

FIG. 3 illustrates an example in which the slide 300 has a plate shape. The slide 300 may have a wave shape in a front view. In other words, the door-side end surface of the slide 300 may have a wave shape. The pitch P of the wave may be set smaller than the width of the ice cells 112 and the height of the ice cells 112. Since the size of the ice pieces produced in the ice tray 110 may vary depending on the ice cells 112, the pitch P of the wave is set smaller than the width and height of the ice pieces. Accordingly, the pitch P of the wave may be smaller than the size of the ice pieces. The slide 300 with the wave shape can advantageously reduce friction between the slide 300 and the ice pieces.

In the illustrated example, the slide 300 is a separate unit from, and disposed independently of, the ice-storing unit 200. However, this implementation is merely exemplary and the present disclosure is not limited thereto. For example, the slide 300 may be integrally formed with the ice-storing unit 200.

Hereinafter, the exemplary operations and functions of the ice-making device 30 for a refrigerator configured as above are described. During operation, water is introduced into the ice tray 110 from the outside. Water in the ice tray 110 freezes into ice pieces by cold air supplied from the cooling system 120. The cooling system 120 is disposed within the ice-making device 30 and directly contacts the rear wall thereof.

Accordingly, when cold air is supplied from the cooling system 120 through the duct disposed in the rear wall, the length of a passage through which the cold air or the refrigerant passes is relatively short, thereby reducing cooling loss. In other words, the cooling system 120 may receive cold air or refrigerant without a passage located between the ice-making unit 100 and the rear wall. When the water is completely frozen in the ice tray 110, ice pieces in the ice tray 110 may be fed to the ice storage part 210.

When the ice pieces are released, the ice-releasing member 113 and the heating unit 130 may be driven. For example, the heating unit 130 may heat the ice tray 110 prior to releasing the ice pieces. The portions of the ice pieces near the walls of the ice tray 110 may be melted by heat from the heating unit 130. Thereafter, the ice-releasing member 113 can be activated to discharge ice pieces from the ice tray 110 to the outside.

Since the ice tray 110 traverses between a space above the ice storage part 210 and a space above the drive device 222, some of the ice pieces discharged from the ice tray 110 may be dropped toward the drive device 222 and the rest of the ice pieces discharged from the ice tray 110 may be directly dropped toward the ice storage part 210. The upper portion of the drive device 222 is covered by the slide 300. The slide 300 is inclined downward toward the ice storage part 210. Thus, the ice pieces dropped toward the drive device 222 can slide along the slide 300 and are guided to the ice storage part 210.

The ice pieces fed to the ice storage part 210 may be kept cold by cold air supplied from the cooling system. The cold air may be discharged from the outflow portion 123 of the duct 121 and may be supplied to the ice pieces.

The ice tray 110 may have an increased number of ice cells 112, thereby advantageously allowing production of additional ice pieces at one time. In addition, the ice tray 110 can be cooled without requiring a passage (such as a duct or the like) disposed between the inner wall of the ice-making device 30 and the ice-making unit 100. This can advantageously reduce cooling loss.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. An ice-making device for a refrigerator, the ice-making device comprising:

an ice-making unit comprising an ice tray, wherein the ice tray is configured to: receive water; and allow the water to freeze into ice pieces therein;

an ice-storing unit configured to store ice pieces supplied from the ice making unit; and a slide configured to guide ice pieces discharged from the ice tray toward the ice-storing unit, wherein the ice-storing unit comprises:

an ice storage part configured to accommodate ice pieces released from the ice-making unit; and a drive device configured to drive a delivery member for discharging the ice pieces from the ice storage part, wherein the ice tray extends to a space located above the drive device, the slide is disposed above the drive device and configured to cover an upper portion of the drive device, and one end of the slide is connected to one end of the ice-storing unit and the other end of the slide is connected to a bottom portion of the ice-making unit.

2. The ice-making device of claim 1, wherein the slide has a cross section of a wave-like profile.

3. The refrigerator of claim 2, wherein a pitch of the wave-like profile is less than a dimension of an ice-piece produced in the ice-making unit.

4. The ice-making device of claim 1, wherein the ice-making unit is configured to directly contact two opposite end walls of the ice-making device.

5. A refrigerator comprising:

an evaporator; and an ice-making device comprising:

an ice-making unit comprising an ice tray, wherein the ice tray is configured to: receive water; and allow the water to freeze into ice pieces therein;

an ice-storing unit configured to store ice pieces supplied from the ice making unit; and a slide configured to guide ice pieces discharged from the ice tray toward the ice-storing unit, wherein the ice-storing unit comprises:

an ice storage part configured to accommodate ice pieces released from the ice-making unit; and a drive device configured to drive a delivery member for discharging the ice pieces from the ice storage part, wherein the ice tray extends to a space located above the drive device, the slide is disposed above the drive device and configured to cover an upper portion of the drive device, and one end of the slide is connected to one end of the ice-storing unit and the other end of the slide is connected to a bottom portion of the ice-making unit, and wherein the ice-making unit is configured to directly contact with opposite end walls of the ice-making device.

6. The refrigerator of claim 5, wherein the slide has a cross section of a wave-like profile.

7. The refrigerator of claim 6, wherein a pitch of the wave-like profile is less than a dimension of an ice-piece produced in the ice-making unit.

* * * * *